US006000467A

United States Patent [19]

Tokizaki et al.

[11] Patent Number: 6,000,467

[45] Date of Patent: Dec. 14, 1999

[54] MULTI-BORED FLAT TUBE FOR USE IN A HEAT EXCHANGER AND HEAT EXCHANGER INCLUDING SAID TUBES

[75] Inventors: Kazumi Tokizaki; Yutaka Higo; Nobuaki Go; Shigeharu Ichiyanagi, all of Tochigi, Japan

[73] Assignee: Showa Aluminum Corporation, Osaka, Japan

[21] Appl. No.: 09/087,016

[22] Filed: May 29, 1998

[30] Foreign Application Priority Data

May 30, 1997 [JP] Japan ..... 9-142017
Mar. 19, 1998 [JP] Japan ..... 10-069957

[51] Int. Cl.[6] ..... F28F 1/02

[52] U.S. Cl. ..... 165/134.1; 165/110; 165/177

[58] Field of Search ..... 165/110, 134.1, 165/177, 183

[56] References Cited

U.S. PATENT DOCUMENTS 5,251,692 10/1993 Haussmann ..... 165/177

FOREIGN PATENT DOCUMENTS 69.269 10/1958 France ..... 165/183
63-91492 4/1988 Japan ..... 165/183
363083 12/1931 United Kingdom ..... 165/177
2133525 7/1984 United Kingdom ..... 165/134.1

*Primary Examiner*—Allen Flanigan

[57] ABSTRACT

A multi-bored flat tube has outermost unit passages located at both ends of the tube and intermediate unit passages between the outermost unit passages. The outermost unit passage has a circular-based inner surface in cross-section, such as a circumferentially smooth curved shape in cross-section like a perfect circular shape or elliptical shape, or has a circular-based inner surface in cross-section having a plurality of inner fins extending in a longitudinal direction of the tube. The intermediate unit passage has a non-circular based cross-sectional shape, such as rectangular, triangular, trapezoidal, or circular based shape including a plurality of inner fins. The tube is strong against being hit by a stone and has a high heat exchanging performance.

9 Claims, 14 Drawing Sheets

MULTI-BORED FLAT TUBE FOR USE IN A HEAT EXCHANGER AND HEAT EXCHANGER INCLUDING SAID TUBES

BACKGROUND OF THE INVENTION

1. Field of the Invention

The present invention relates to a multi-bored flat tube for use in a heat-exchanger and, more particulary, to a multi-bored flat tube made of a metal such as an aluminum for use in a condenser for an air conditioner. The present invention further relates to a heat exchanger including the multi-bored flat tubes.

2. Description of the Related Art

FIGS. 14(A)–(C) show cross-sectional views of a conventional multi-bored flat tube of this kind. The multi-bored flat tube 51 is made by extruding an aluminum. The tube 51 has a peripheral wall 52 having an elongated circular cross-sectional shape and a plurality of divisional wall 53, 53*a* connecting flat wall portions 52*a*, 52*a* of the peripheral wall 52. The divisional walls 53 divide an inside space of the tube 51 to form a plurality of unit passages 54, 55 arranged in a lateral direction of the tube 51. Each divisional wall 53, 53*a* has a constant thickness along the height thereof so that a contact area with the heat exchanging medium can be enlarged, thereby enhancing the heat exchanging performance of the tube 51. The tube 51 includes outermost unit passages 54, 54 and intermediate unit passages 55 located between the outermost unit passages 54, 54. Each intermediate passage 55 has a rectangular cross-sectional shape, and each outermost unit passage 54 has a semi-circular cross-sectional shape at a lateral outside portion and a rectangular cross-sectional shape at lateral inside portion. Further, each portion of the tube 51, i.e., the peripheral wall 52 and the divisional walls 53, 53*a*, are formed to be as thin as possible for the purpose of lightening the weight of the tube 51.

Japanese unexamined Utility Model Publication No. S60-196181 and Japanese examined Utility Model Publication No. H3-45034 disclose a tube having unit passages with inner fins formed on an inner surface of each unit passage to enlarge a contact area with the heat exchanging medium for the purpose of enhancing the heat exchanging performance. For example, as shown in FIGS. 15A and 15B, a tube 52 has a plurality of inner fins 62 formed on the inner surface of the unit passages 54, 55 surrounded by the peripheral wall 52 and the divisional walls 53, 53*a*. Each fin 62 has a triangular cross-sectional shape and extends in the longitudinal direction of the tube 61.

Japanese unexamined Patent Publication No. H5-215482 discloses another type of heat exchanging multi-bored flat tube. The tube has a plurality of unit passages each having a round cross-sectional shape for the purpose of equalizing the flow speed of the heat exchanging medium and lowering the flow resistance of the heat exchanging medium in each unit passage. FIGS. 14 and 15, the reference numeral 57 denotes a corrugate fin interposed between the adjacent tubes 61.

In a heat exchanger including the above-mentioned flat tubes 51, 61, a stress caused by an inner pressure of the heat exchanging medium passing through the tube is concentrated on connecting portions between the divisional wall 53, 53*a* and the peripheral wall 52. The lateral middle portion of the tube 51, 61 can withstand such a stress because the flat wall portions 52*a* of the peripheral wall 52 are supported and reinforced by the corrugate fins 57, 57. However, the lateral end portions of the tube 51, 61 are not strong enough to withstand such a stress because reinforcing effects obtained by the corrugate fins 57, 57 are not enough. Therefore, such a stress tends to be concentrated on the connecting portions between the outermost dividing wall 53*a* and the peripheral wall 52 to cause a breakage.

Further, as shown in FIGS. 14B and 14C, the above-mentioned tubes used in a condenser mounted in an automobile may sometimes be damaged and cause leakage of the heat exchanging medium when a stone, or the like, hits the tube while the automobile is moving.

The above-mentioned problems may be solved by thickening the dividing wall portion 53, 53*a* and the peripheral wall 52. However, this causes an increase in the tube weight, resulting in an increase in the heat exchanger weight.

In a tube having a plurality of unit passages each having a perfect circular cross-sectional shape, a flow resistance of heat exchanging medium passing through the unit passage can be decreased and the pressure resistance can be improved. However, upper and lower portions of each dividing wall are thicker than the middle portion thereof, which requires larger amount of material for forming the tube, thereby increasing the manufacturing costs. Further, within a limited tube thickness, a heat transferring area of the circular cross-sectional unit passage is smaller than that of the rectangular cross-sectional unit passage, resulting in a lower heat exchanging efficiency.

SUMMARY OF THE INVENTION

The present invention has been made to overcome the disadvantages in the conventional multi-bored flat tube for use in a heat exchanger as described above.

An object of the present invention is to provide a multi-bored flat tube having an improved strength against a stone or the like which hits the tube, and an excellent heat exchanging performance by keeping a large contact area with a heat exchanging medium.

Another object of the present invention is to provide a heat exchanger including the above-mentioned flat tubes.

According to the one aspect of the present invention, the above-referenced objects can be achieved by a multi-bored flat tube for use in a heat exchanger, comprising:

a peripheral wall including flat wall portions facing each other at a certain distance and sidewall portions connecting lateral ends of the flat wall portions; and dividing walls connecting the flat wall portions and dividing an inner space defined by the peripheral wall into a plurality of unit passages arranged in a lateral direction of the tube.

The plurality of unit passages include outermost unit passages located at both lateral ends of the tube and intermediate unit passages located between the outermost unit passages.

Each of the outermost unit passages has a circular-based inner surface in cross-section, and each of the intermediate unit passages has a non-circular inner surface in cross-section.

In the tube according to the present invention, since the outermost unit passages have a circular-based inner surface in cross-section, a stress concentration on connecting portions between the outermost dividing wall and the peripheral wall can be decreased. Accordingly, a high pressure resistance can be obtained throughout the tube. In a heat exchanger including the multi-bored flat tube, a high pressure resistance can be obtained by the structure even at both lateral ends of the tube where reinforcing effect by the outer fins is not enough.

In particular, when the outermost unit passage is designed to have a circular cross-sectional shape, an inner pressure of the heat exchanging medium passing through the passage acts on the inner surface of the passages equally in the circumferential direction thereof. Therefore, a higher pressure resistance can be obtained. This effect is remarkable when the outermost unit passage is designed to have a perfect circular shape. Furthermore, since the outermost unit passage is designed to have a circular-based inner surface in cross-section, a stress concentration on connecting portions between the outermost dividing wall and the peripheral wall can be reduced even when a small article such as a stone hits the tube. Consequently, the peripheral wall at the connecting portions can be prevented from being damaged, resulting in superior breaking strength against an outside stress caused when small article such as a stone hits the tube.

The outermost unit passage may have a circumferentially smooth curved shape in cross-section. This circumferentially smooth curved shape in cross-section includes various kinds of circular shapes such as a perfect circular shape, an elliptical shape, an elongated circular shape, or the like.

Furthermore, the outermost unit passage may have a star-like shape in cross-section, i.e., a circular-based cross-sectional shape having a plurality of inner fins extending in a longitudinal direction of the tube. In this case, the contact area with the refrigerant can be enlarged, thereby improving the heat exchange performance.

Each of the intermediate unit passages is designed to have a non-circular inner surface in cross-section. This can prevent the thickness of upper and lower portions of the dividing wall from being thickened as compared to an intermediate unit passage having a circular-based inner surface, which results in a decreased amount of materials, thereby decreasing the weight and costs of the tube. In addition, within a limited thickness of the tube, a larger contact area with the heat exchanging medium can be obtained as compared to an intermediate unit passage having a circular inner surface, which in turn can obtain a high heat exchanging performance. In this specification, the word "non-circular" means other than circular and includes any kinds of shape, such as a triangular shape, a square shape, a trapezoidal shape, a star-like shape as well as a shape having uneven inside surfaces thereof.

The intermediate unit passage adjacent to the outermost unit passage may have a semi-circular inner surface at the outermost unit passage side. This can decrease a stress concentration on the connecting portions between the outermost dividing wall and the peripheral wall to improve the strength, whereby the peripheral wall at the connecting portions can effectively be prevented from being broken.

The sidewall portion may have a rounded shape in cross-section and may be formed relatively thicker than the flat wall portions. This can prevent the sidewall portion from being broken or deformed when a small article such as a stone hits the sidewall portion. In addition, since the thickness of the flat wall portions is kept relatively thinner, an optimal heat transmission performance can be maintained and an increase in the weight can be avoided, resulting in a light-weight heat exchanger. Further, the structure does not cause an increased pressure loss of the heat exchanging medium.

The intermediate unit passages may have a square, triangular, or trapezoidal shapes in cross-section. In the case of intermediate unit passages having triangular or trapezoidal shapes, it is preferable to invert the orientation of adjacent passages in order to have as many unit passages as possible. The intermediate unit passage can have a large heat transmission area as compared with a passage having a circular shape in cross-section, thereby improving the heat-exchanging efficiency.

The intermediate unit passages may also have a star-like shape in cross-section, that is a circular-based shape having a plurality of inner fins extending in a longitudinal direction of the tube. In this case, since the cross-section has a circular-based shape, a high performance of pressure-resistance can be obtained. Even though the cross-section has a circular-based shape, the passage can have a large heat transmission area due to the inner fins. Even if the cross-section does not have a circular-based shape, the same effect can be obtained when the inner surface has a plurality of inner fins extending in a longitudinal direction of the tube.

According to another aspect of the present invention, the above-referenced objects can be achieved by a multi-bored flat tube for use in a heat-exchanger comprising;

a peripheral wall including flat wall portions facing with each other at a certain distance and sidewall portions connecting ends of the flat wall portions; and dividing walls connecting the flat wall portions and dividing an inside space defined by the peripheral wall into a plurality of unit passages arranged in a lateral direction of the tube, wherein the plurality of unit passages include outermost unit passages located at both lateral ends of the tube and intermediate unit passages located between both the outermost unit passages, and wherein each of the outermost unit passages has a circular-based inner surface in cross-section, and each of the intermediate unit passages has a modified inner surface in cross-section.

In this case, since the outermost unit passages are designed to have a circular-based inner surface in cross-section, a stress concentration on the connecting portion between the outermost dividing wall and the peripheral wall can be reduced. A high performance of pressure resistance can be obtained throughout the tube, and a superior breaking strength against an outside stress caused when a small article such as a stone hits the tube can be obtained.

Furthermore, each of the intermediate unit passages is designed to have a modified cross-sectional shape. This can prevent the thickness of upper and lower portions of the dividing wall from being thickened as compared to an intermediate unit passage having a circular inner surface in cross-section, which results in a decreased amount of material, thereby decreasing the weight and costs of the tube. In addition, within a limited thickness of the tube, a larger contact area with the heat exchanging medium can be obtained as compared to an intermediate unit passage having a circular inner surface in cross-section, which in turn can obtain a high heat exchanging performance. Concretely, it is preferable to have a plurality of inner fins extending in a longitudinal direction of the tube on a square-based inner surface in cross-section. In this case, in addition to an increase in the heat transmission area caused by the inner fins, an even higher heat exchanging performance can be obtained.

A heat-exchanger having the above-mentioned multi-bored flat tube can improve a breaking strength against a small article such as a stones which hits the tube, and can maintain a high heat transmission performance and a low pressure loss.

Other objects, features and advantages of the present invention will now be clarified by the following explanation of the preferred embodiments.

BRIEF EXPLANATION OF THE DRAWINGS

FIGS. 1A and 1B show a tube of an embodiment according to the present invention, wherein FIG. 1A is a cross-sectional view thereof, and FIG. 1B is an enlarged cross-sectional view of the lateral end portion thereof.

FIGS. 3A and 3B show a heat exchanger, wherein FIG. 3A is a front view thereof, and FIG. 3B is a top plan view thereof.

FIGS. 7A and 7B show a second embodiment of the tube according to the present invention, wherein FIG. 7A is a cross-sectional view of the tube, and FIG. 7B is an enlarged cross-sectional view of the lateral end portion thereof.

FIGS. 10A and 10B show a fifth embodiment of the tube according to the present invention, wherein FIG. 10A is a cross-sectional view of the tube, and FIG. 10B is an enlarged cross-sectional view of the lateral end portion thereof.

FIGS. 12A and 12B show a sixth embodiment of the tube according to the present invention, wherein FIG. 12A is a cross-sectional view thereof, and FIG. 12B is an enlarged cross-sectional view of the lateral end portion thereof.

FIGS. 13A and 13B show a seventh embodiment of the tube according to the present invention, wherein FIG. 13A is a cross-sectional view thereof, and FIG. 13B is an enlarged cross-sectional view of the lateral end portion thereof.

FIGS. 14A–14C show related art, wherein FIG. 14A is a cross-sectional view of a conventional tube, FIG. 14B is a partial cross-sectional view of a heat exchanger core including the tubes and fins, and FIG. 14C is an enlarged partial cross-sectional view of the tube to which a stone hit.

FIGS. 15A–15B show other related art, wherein FIG. 15A is a cross-sectional view of a partial cross-sectional view of a heat exchanger core including the tubes and fins, and FIG. 15B is an enlarged partial cross-sectional view thereof.

DETAILED DESCRIPTION OF THE PREFERRED EMBODIMENTS

A preferred embodiment of the present invention will now be described with reference to the accompanying drawings.

The multi-bored flat tube for use in a heat exchanger of the embodiment and a heat exchanger including the tubes are preferably used as a condenser for an automobile air conditioner.

Figure 3A:
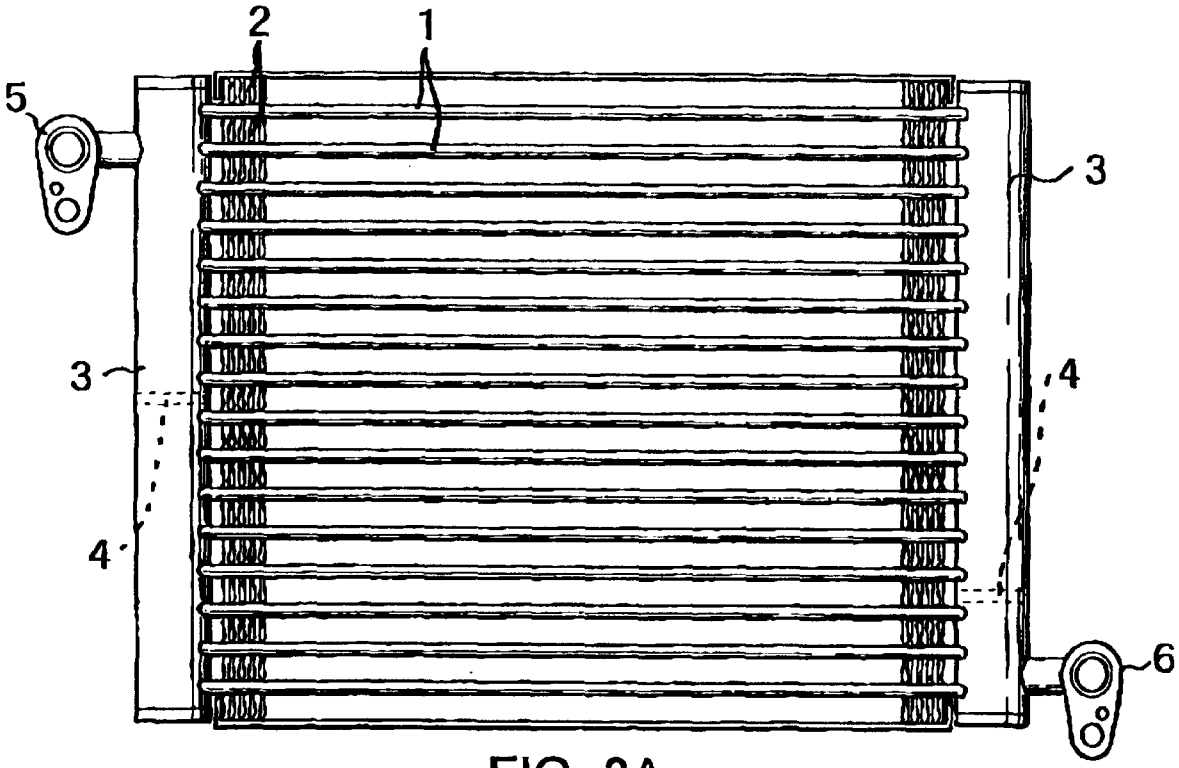
Figure 3B:
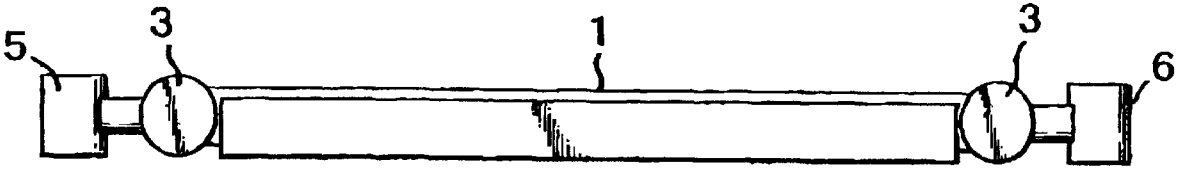

FIG. 3 shows a heat exchanger of a so-called multi-flow type that includes a plurality of multi-bored flat tubes 1 each having a certain length, fins 2 interposed between the tubes 1, and a pair of hollow headers 3, 3 to which the ends of the tubes 1 are connected. Each header 3 is divided by a partition 4 into upper and lower chambers. A heat exchanging medium flows into the left hand header 3 through an inlet 5 connected to the upper portion of the header, passes through the tubes 1 in a zigzag manner, and flows out of the right hand header 3 through an outlet 6 connected to the lower portion of the header 3.

First Embodiment

FIGS. 1 and 2 show a multi-bored flat tube 1 of the first embodiment used in the above-mentioned heat exchanger.

Figure 1A:
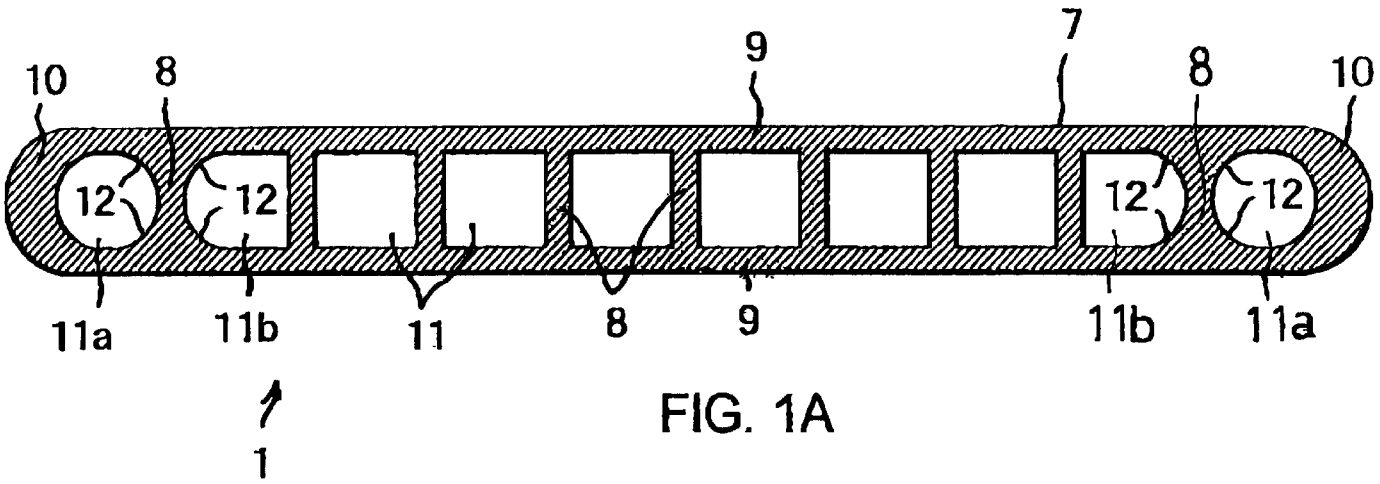
Figure 1B:
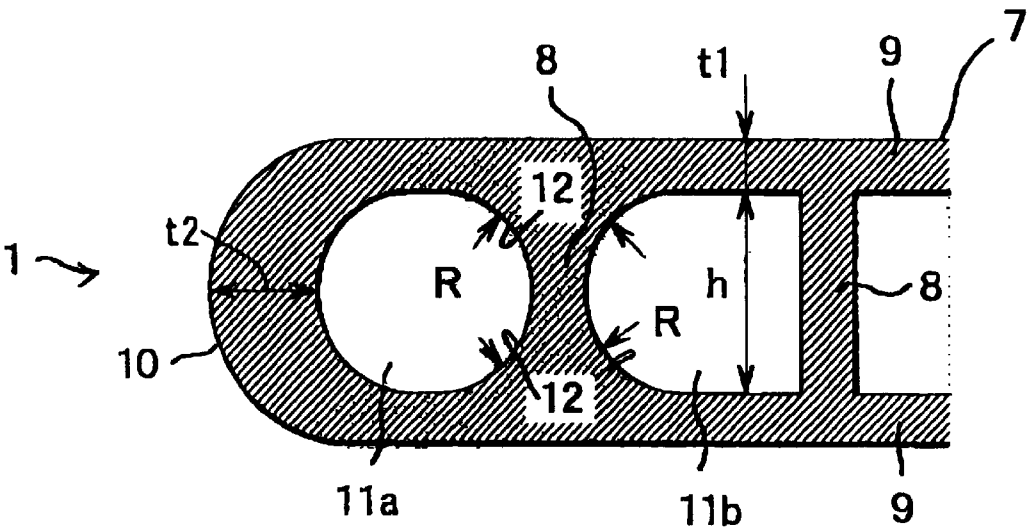

The tube 1 is an aluminum extruded article. As shown in FIGS. 1A and 1B, the peripheral wall 7 is formed to have an elongated circular cross-sectional shape. A plurality of divisional walls 8 are provided in the tube 1 to form a plurality of unit passages 11, 11*b*, 11*a* arranged in the lateral direction of the tube 1. The divisional walls 8 connect flat wall portions 9, 9 of the peripheral wall 7 faced with each other at a certain distance.

This tube 1 has rounded sidewall portions 10, 10 at the lateral end portions of the tube. The sidewall portion 10 is formed to be thicker than the flat wall portion 9. For example, the maximum thickness t2 of the sidewall portion 10 can be designed to be 0.7 mm where the thickness t1 of the flat wall portion 9 is 0.35 mm.

The inner surface of each of the outermost unit passages 11*a*, 11*a* is formed to be a circumferentially smooth curved shape in cross-section. In this embodiment, the unit passage 11*a* is formed to be an elongated circular cross-sectional shape, but it may be formed to be an elliptical shape or a perfect circular shape. Each intermediate unit passage 11*b* adjacent to the outermost unit passage 11*a*, i.e., the second passage 11*b* from the lateral end of the tube 1, has a rounded, or semicircular, inner surface at the outermost unit passage side and a rectangular inner surface at the other side. As shown in FIG. 1B, each radius curvature R of the curved inner surfaces 12, 12, 12, 12 located at connecting portions between the outermost dividing wall 8 and the flat wall portions 9 is preferably designed to be approximately half of the height h of the unit passages 11.

Figure 2A:
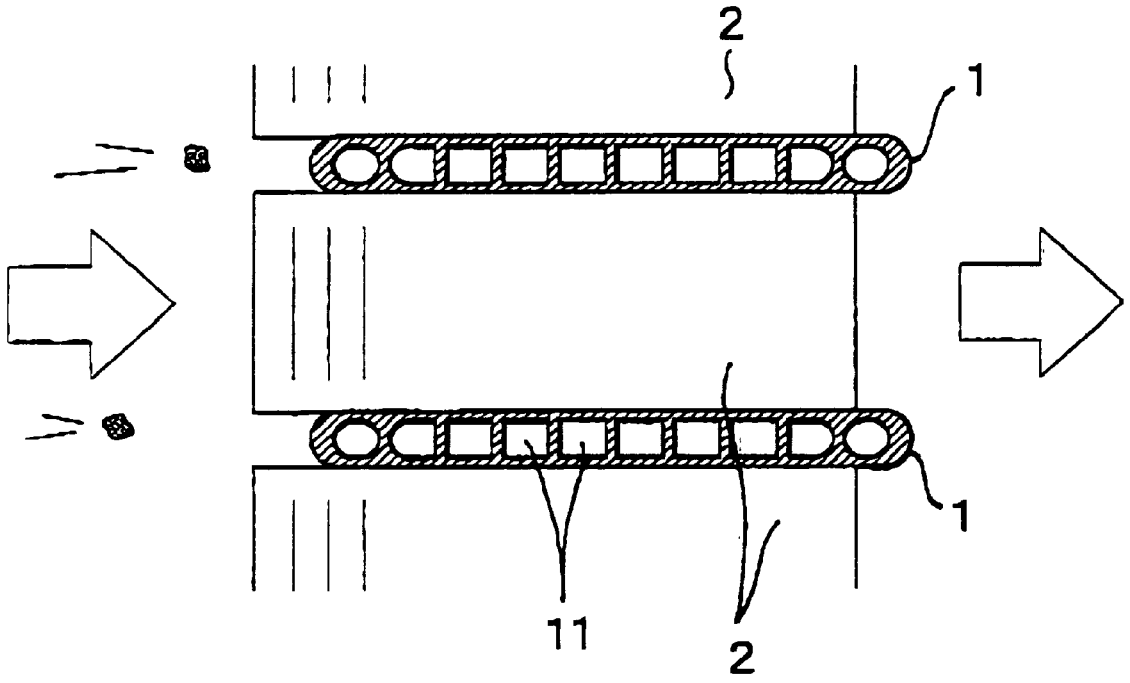
FIG. 2A is a part of cross-sectional view of a heat exchanger core including the tubes and fins.

The fin 2 is an aluminum corrugate fin. As shown in FIG. 2A, the fin 2 is disposed between adjacent tubes 1, 1 such that one lateral end of the fin 2 protrudes from one lateral end of the tube 1 toward leeward side. In the embodiment shown in FIG. 2A, the width of the fin 2 is the same as that of the tube 1 and, therefore, the other lateral end of the fin 2 is indented from the other lateral end of the tube 1 at rearward side. However, the width of the fin 2 may be designed to be larger than that of the tube 1 so that one lateral end of the fin 2 protrudes from one lateral end of the tube 1 toward windward side and the other lateral end is not indented from the other lateral end of the tube 1 at rearward side.

Figure 2B:
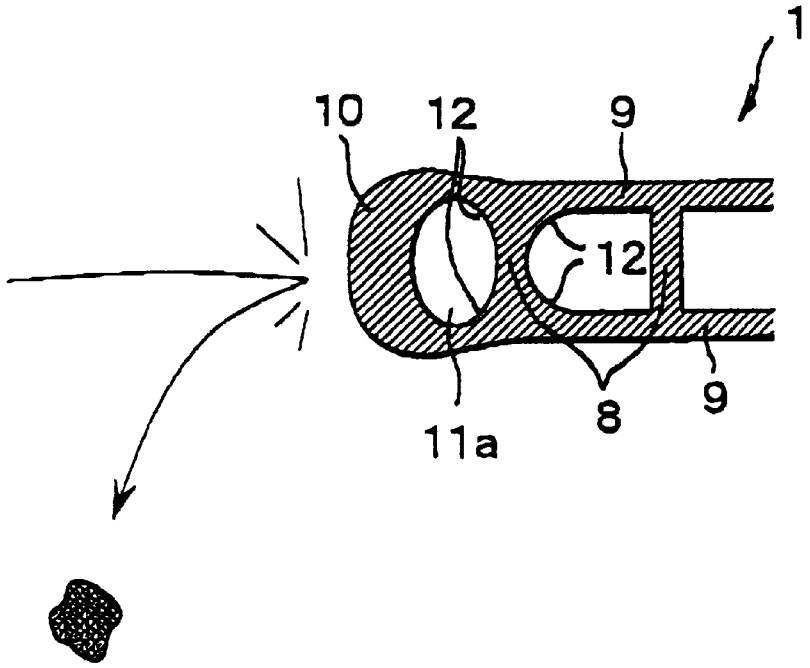
FIG. 2B is an enlarged cross-sectional view of the lateral end portion thereof against which a stone hits.

When the above-mentioned heat exchanger is used as a condenser for an automobile air conditioner, the heat exchanger may be hit by a stone passed through a radiator grill of the automobile. In this case, however, the rounded sidewall portion 10 is prevented from being destroyed by the stone because the thickness of the rounded sidewall portion 10 at the windward side is larger than that of the flat wall portion 9. Further, the rounded sidewall portion 10 is also prevented from being heavily deformed by the stone, and a stress concentration on connecting portions between the outermost dividing wall 8 and the flat wall portion 9 is decreased due to the stress concentration decreasing effect of the curved inner surfaces 12, 12, 12, 12, which prevents the peripheral wall 7 at the connecting portions from being damaged. FIG. 2B shows a stone hitting the rounded sidewall portion 10.

In addition, since the thicknesses of the flat wall portions 9, 9 are kept relatively thinner, an optimal heat transmission performance can be maintained and a weight increase can be decreased, resulting in a light-weight heat exchanger. Further, the structure does not cause an increase in the pressure loss of the heat exchanging medium. The fins 2 can also receive a stone to protect the tubes 1.

Figure 4:
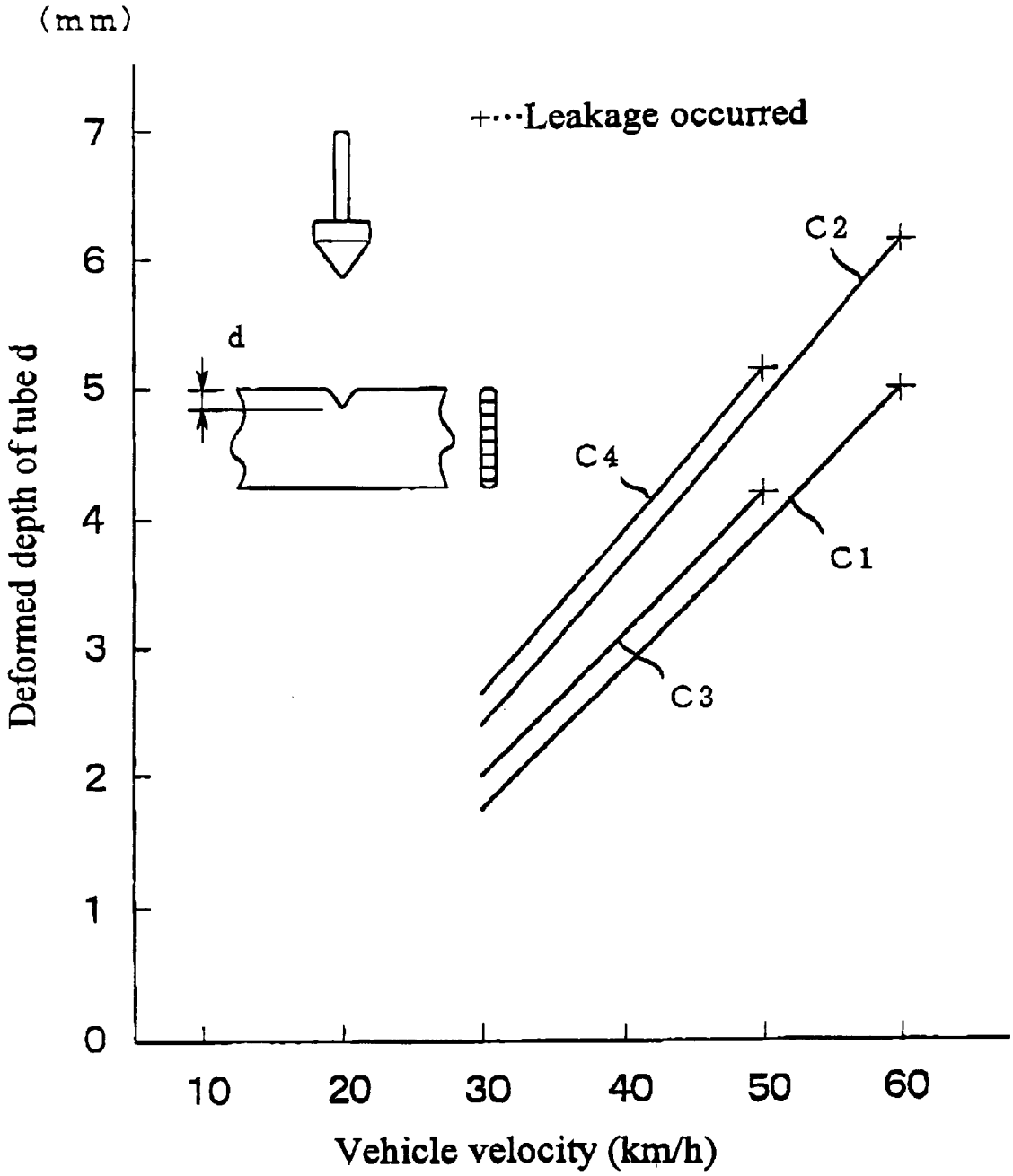
FIG. 4 is a graph showing examination results of the strength.

The following four types of condensers were prepared to compare the strength thereof. First, a condenser C1 having tubes 1 of the present invention shown in FIG. 1A and fins 2 interposed between adjacent tubes was prepared. One lateral end of the fin 2 protruded from one lateral end of the tube 1 toward windward side. Second, a condenser C2 having the tubes 1 and fins 2 interposed between adjacent tubes was prepared. One lateral end of the fin 2 did not protrude from one lateral end of the tube 1 toward windward side. Third, a condenser C3 having the conventional tubes 51 shown in FIG. 14 and fins 57 interposed between adjacent tubes was prepared. One lateral end of the fin 57 protruded from one lateral end of the tube 51 toward windward side. Fourth, a condenser C4 having the conventional tubes 51 and fins 57 interposed between adjacent tubes was prepared. One lateral end of the fin 57 did not protrude from one lateral end of the tube 57 toward windward side. These four condensers C1, C2, C3, C4 were laid down and various sizes of steal weights were dropped from various heights on the condensers. Each steal weight had a size smaller than a distance between the adjacent tubes of the condensers. The results are shown in a graph shown in FIG. 4. In the graph, the vehicle velocity corresponds to the falling velocity of the weight just before the weight contacts the condenser.

From the results, it was confirmed that the tube 1 according to the present invention can be prevented from being deformed or broken by a stone as compared to the conventional tube 51. Further, a lateral end of the fin 2 protruding toward the windward side can effectively prevent a tube from being deformed or broken.

Figure 5:
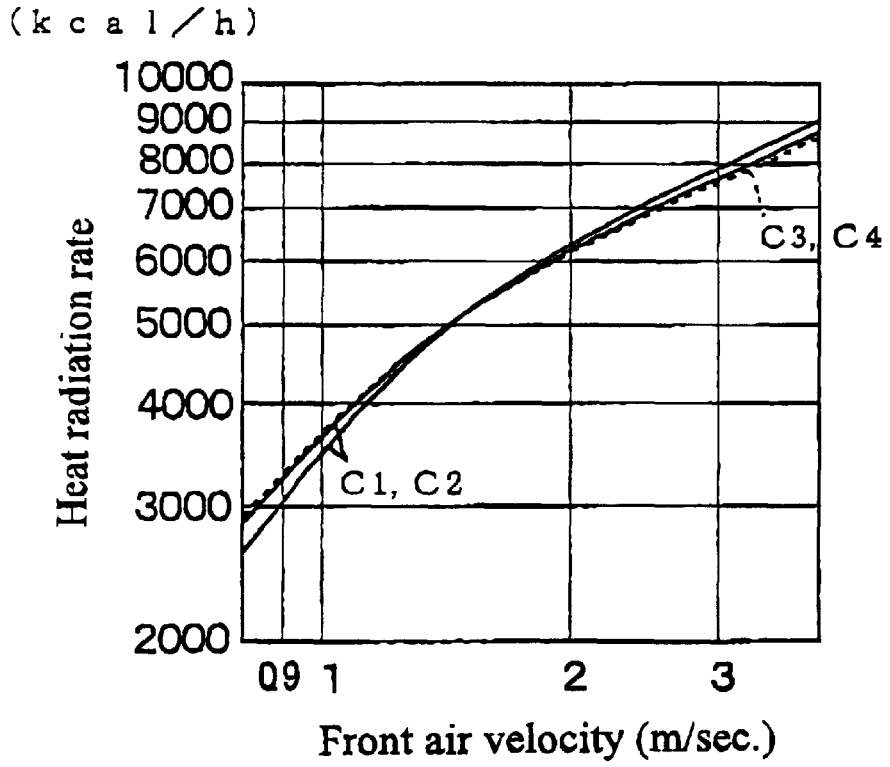
FIG. 5 is a graph showing examination results of the radiation amount.
Figure 6:
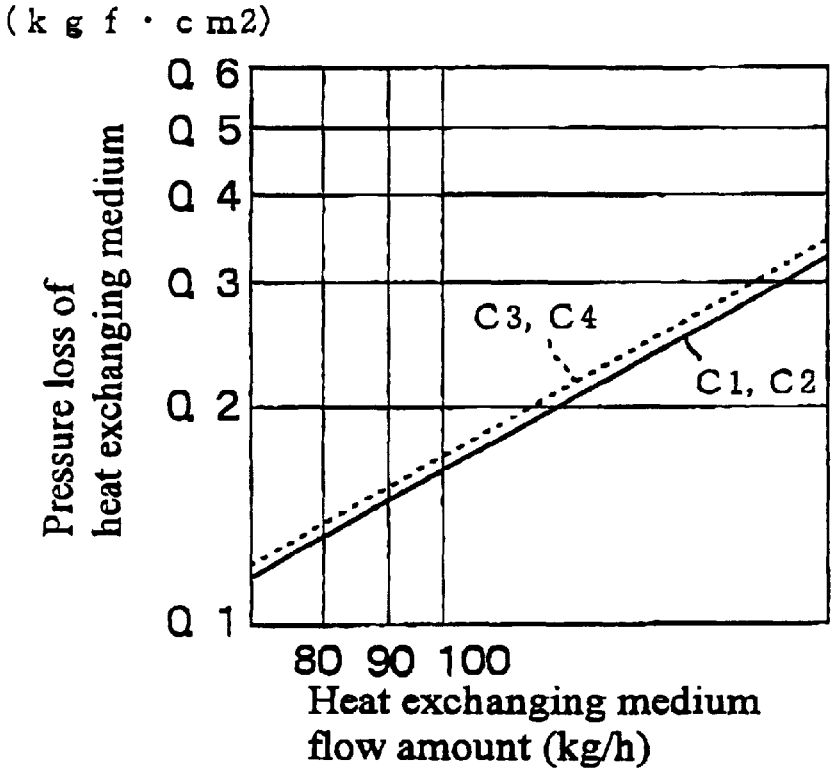
FIG. 6 is a graph showing examination results of the pressure loss of the heat exchanging medium.

The heat radiation rate and the pressure loss of the heat exchanging medium were also measured for each condenser. The results are shown in FIGS. 5 and 6. From the results, it was confirmed that the heat radiation rate and the pressure loss of the condensers C1 and C2 were as good as those of the conventional condensers C3 and C4.

Second Embodiment

Figure 7A:
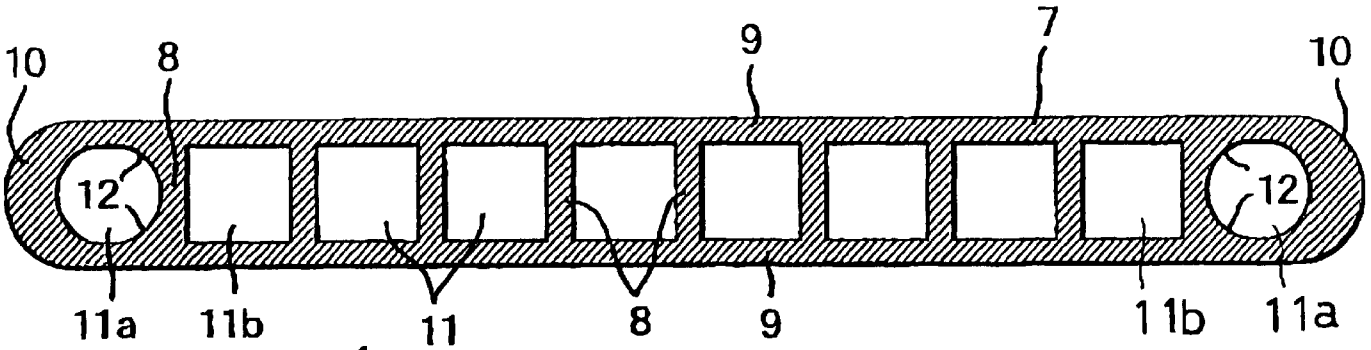
Figure 7B:
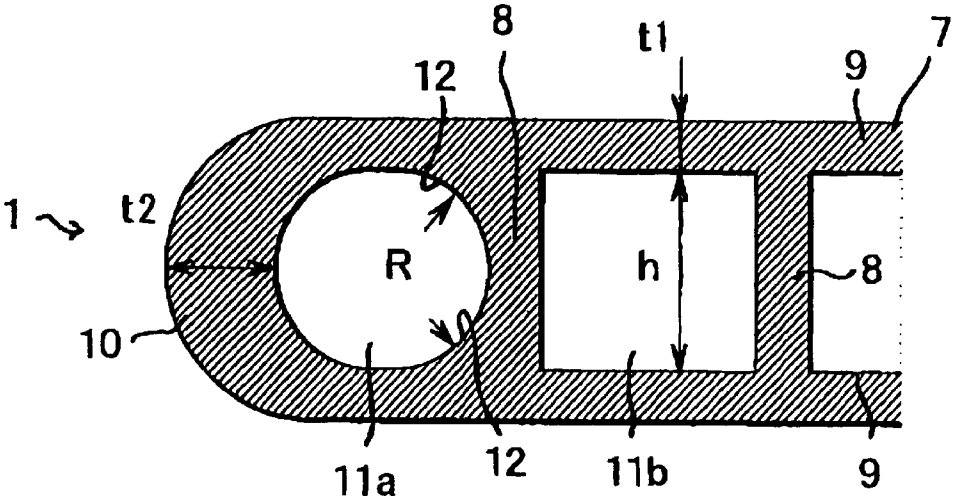

FIG. 7 shows a second embodiment of a multi-bored flat tube according to the present invention. This embodiment differs from the first embodiment only in that the second unit passages 11*b*, 11*b* from lateral ends of the tube 1 are also formed to have a rectangular cross-sectional shape.

Since each of the outermost unit passages 11*a*, 11*a* is formed to have a circumferentially smooth curved shape in cross-section, a stress concentration on connecting portions between the outermost dividing wall 8 and the flat wall portion 9 decreases due to the stress concentration decreasing effect of the curved inner surfaces 12, 12, which prevents the peripheral wall 7 at the connecting portions from being destroyed.

Further, since each of the intermediate unit passages 11 is formed to have a rectangular shape in cross-section, the thickness of each portion can be thinner, thereby lightening the weight of the tube 1, resulting in a light weight heat exchanger. Further, the heat exchanging performance can be improved by increasing the contact area with a heat exchanging medium, as compared to a tube having intermediate unit passages each having a round shape in cross-section.

Since the other portions are the same as in the first embodiment, the explanation thereof will be omitted by giving the same numeral to the corresponding portion.

Third Embodiment

Figure 8:
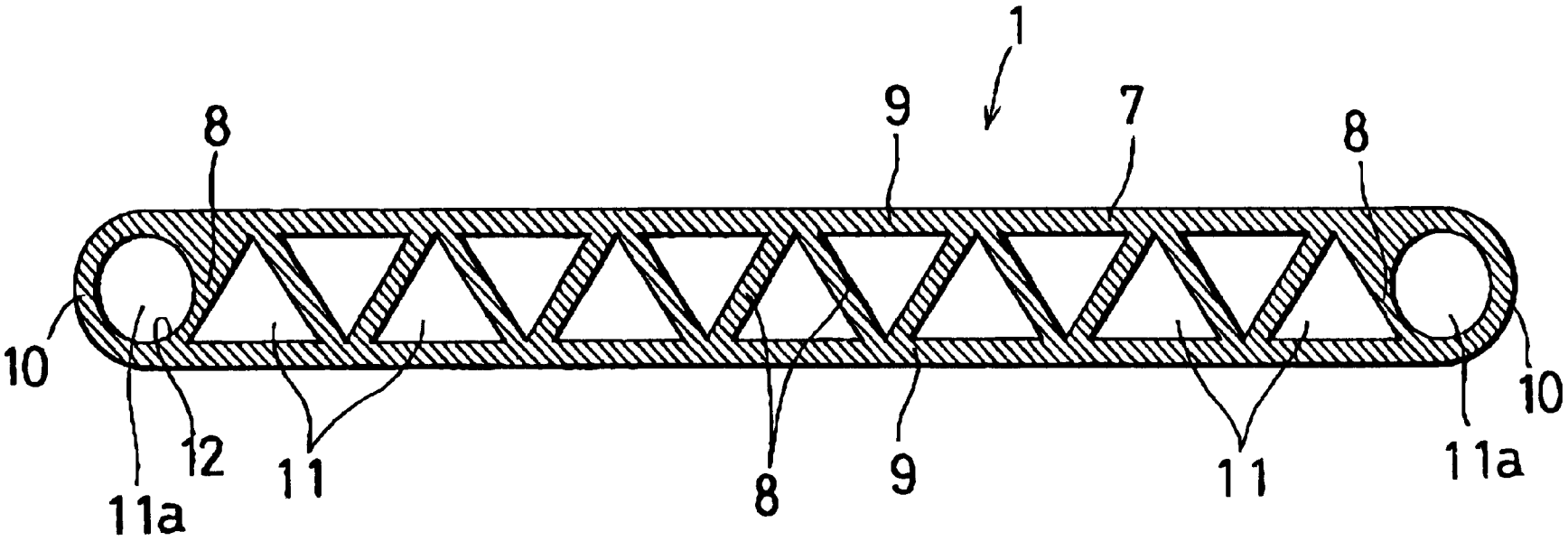
FIG. 8 is a cross-sectional view of a third embodiment of the tube according to the present invention.

FIG. 8 shows a third embodiment of a multi-bored slat tube according to the present invention. In this embodiment, all intermediate unit passages 11 are formed to have a triangular cross-sectional shape, respectively. The adjacent unit passages 11, 11 are disposed upside down (i.e., inverted). The thickness of each rounded sidewall portion 10 located at the lateral end of the tube 1 is approximately the same as that of the flat wall portion 9.

In this embodiment, each of the outermost unit passages 11*a*, 11*a* is formed to have a circumferentially smooth curved shape in cross-section. Therefore, a stress concentration on connecting portions between the outermost dividing wall 8 and the flat wall portion 9 is decreased due to the stress concentration decreasing effect of the curved inner surfaces 12, 12, which prevents the peripheral wall 7 at the connecting portions from being damaged.

Since each intermediate unit passage 11 has a triangular cross-sectional shape, the thickness of each portion can be thinner, thereby lightening the weight of the tube 1, resulting in a light weight heat exchanger, as in the same manner in the first and second embodiments. Further, the heat exchanging performance can be improved by the large contact area with a heat exchanging medium, as compared to a tube having intermediate unit passages each having a round shape in cross-section.

Since the other portions are the same as in the first embodiment, the explanations thereof will be omitted by giving the same numerals to the corresponding portions.

Fourth Embodiment

Figure 9:
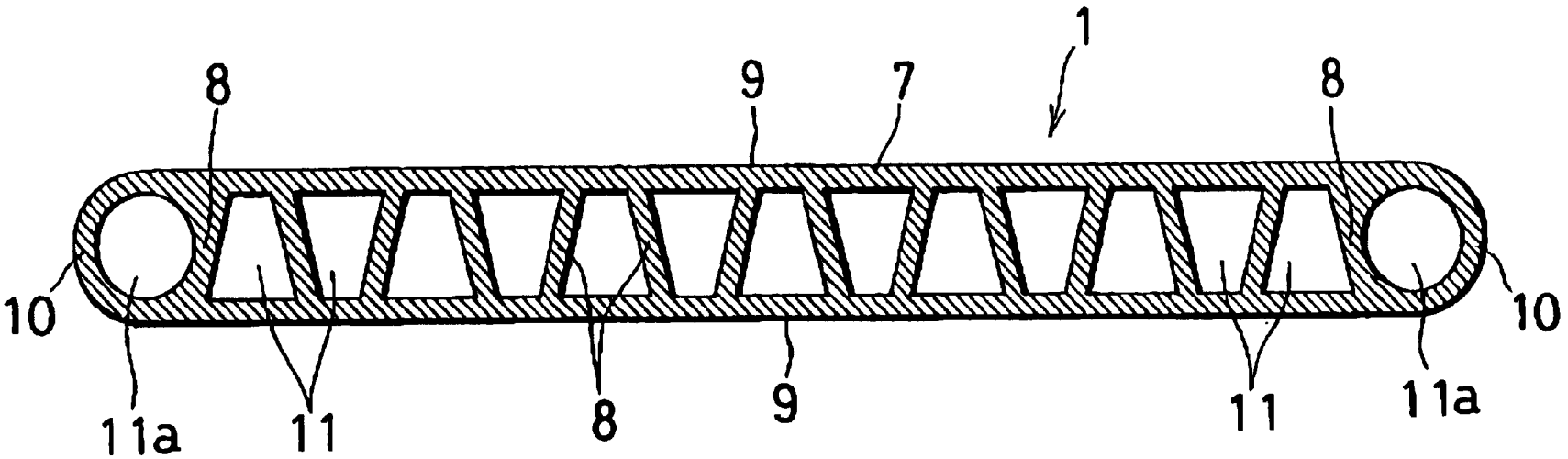
FIG. 9 is a cross-sectional view of a forth embodiment of the tube according to the present invention.

FIG. 9 shows a fourth embodiment of a multi-bored flat tube according to the present invention. In this embodiment, all intermediate unit passages 11 are formed to have a trapezoidal cross-sectional shape, respectively. The adjacent unit passages 11, 11 are again disposed upside down. The thickness of each rounded sidewall portion 10 located at the lateral end of the tube 1 is approximately the same as that of the flat wall portion 9.

In this embodiment, each of the outermost unit passages 11*a*, 11*a* is formed to have a circumferentially smooth curved shape in cross-section. Therefore, a stress concentration on connecting portions between the outermost dividing wall 8 and the flat wall portion 9 decreases due to the stress concentration decreasing effect of the curved inner surfaces 12, 12, which prevents the peripheral wall 7 at the connecting portion from being damaged.

Since each intermediate unit passage 11 has a trapezoidal cross-sectional shape, the thickness of each portion can be thinner, thereby lightening the weight of the tube 1, resulting in a light weight heat exchanger, as in the same manner in the third embodiment. Further, the heat exchanging performance can be improved by the large contact area with a heat exchanging medium, as compared to a tube having intermediate unit passages each having a round shape in cross-section.

Since the other portions are the same as in the first embodiment, the explanations thereof will be omitted by giving the same numerals to the corresponding portions.

Fifth Embodiment

Figure 10A:
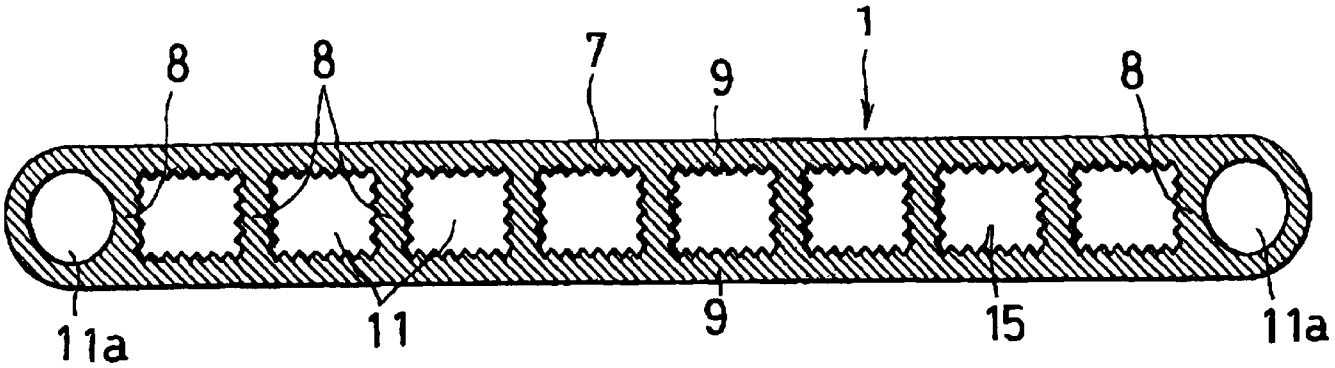
Figure 10B:
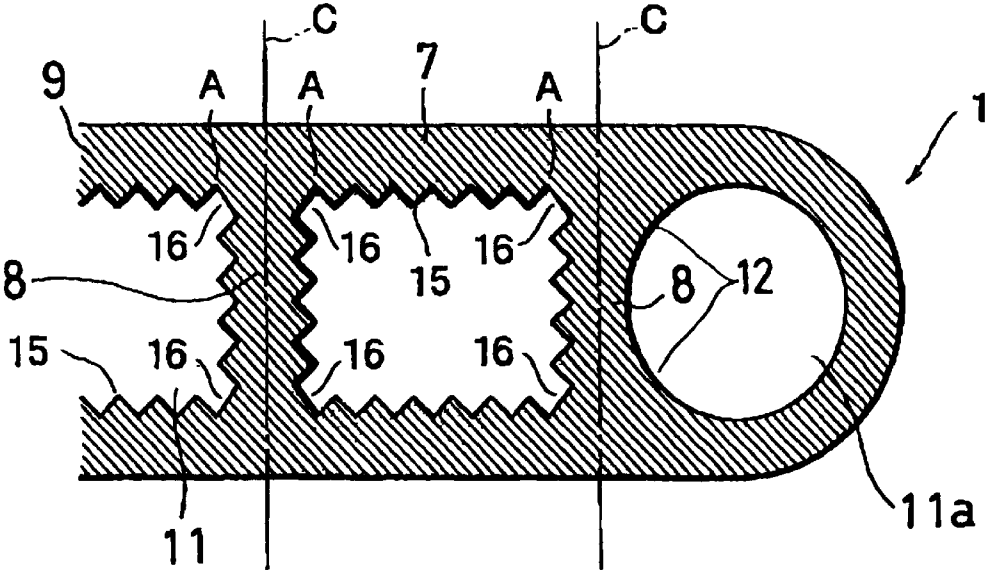
Figure 11A:
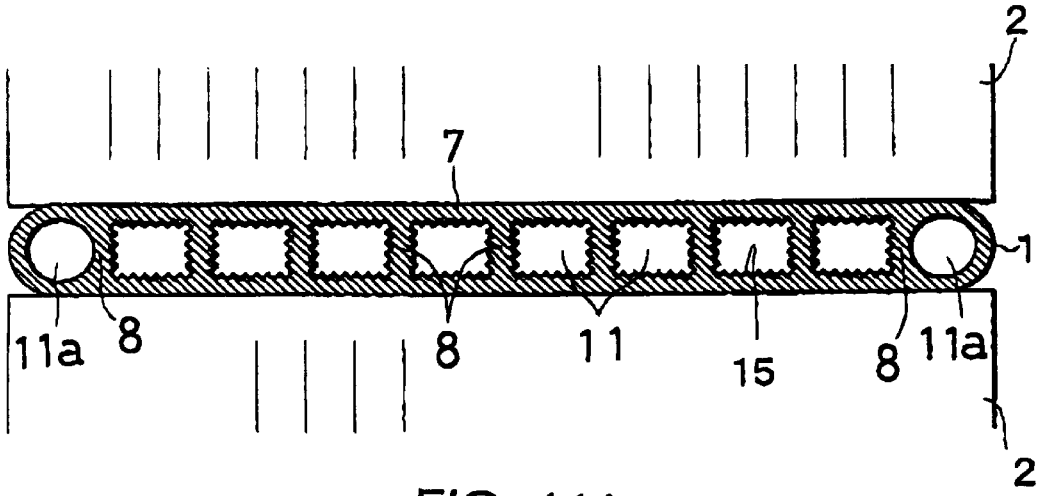
FIG. 11A is a part of cross-sectional view of a heat exchanger core including the tubes and fins.
Figure 11B:
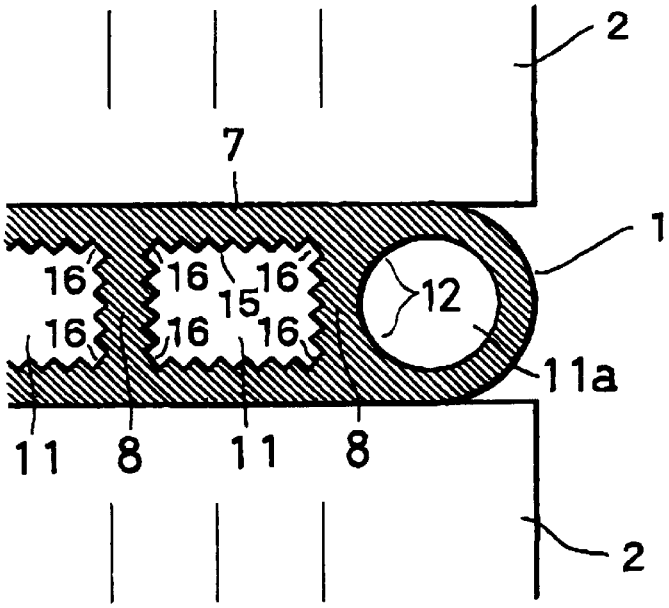
FIG. 11B is an enlarged cross-sectional view of the lateral end portion thereof.

FIGS. 10 and 11 show a fifth embodiment of a multi-bored flat tube 1 according to the present invention. This tube 1 is an aluminum extruded formed article as in the third and fourth embodiments.

The multi-bored flat tube 1 has a pair of outermost unit passages 11*a*, 11*a* and intermediate unit passages 11 therebetween. Each intermediate unit passage 11 has a rectangular-based inner surface in cross-section having a plurality of triangular cross-sectional inner fins 15 continuously formed along the inner surface and extending in the longitudinal direction of the tube 1. As clearly shown in FIG. 10A, an inclined inner surface 16 is formed at each corner of the rectangular-based inner surface in cross-section.

In this tube 1, each outermost unit passage 11*a* is formed to have a perfect circular shape.

Because the flat tube 1 has a plurality of inner fins 15 formed on the rectangular-based inner surface of the intermediate unit passage 11, a contact area with the heat exchanging medium can be increased, whereby a high heat exchanging performance can be obtained.

The flat tube 1 has a plurality of dividing walls 8 connecting the flat wall portions 9, 9, which divide the inner space of the tube 1 into a plurality of unit passages 11, 11*a*, thereby being superior in pressure resistance.

In this embodiment, each of the outermost unit passages 11*a*, 11*a* is formed to have a circular shape in cross-section. Therefore, a stress concentration on connecting portions between the outermost dividing wall 8 and the flat wall portion 9 is decreased due to the stress concentration decreasing effect of the curved inner surfaces 12, 12, which prevents the peripheral wall 7 at the connecting portions from being damaged. The outermost connecting portions are not sufficiently reinforced by the corrugate fins 2 as compared to the other connecting portions. However, because each outermost unit passage 11*a* is formed to have a circular shape in cross-section, a breakage of the connecting portions between the outermost dividing wall 8 and the flat wall portion 7 can be prevented due to the stress concentration diminishing effects, which in turn enhances inner pressure resistance performance of the tube 1. Especially, when the outermost unit passage 11*a* is formed to have a perfect circular shape, the inner pressure of the heat exchanging medium passing through the unit passage can be equalized on the inner surface of the outermost unit passage 11*a*, resulting in extremely high pressure performance.

Because each outermost unit passage 11*a* has a circular cross-sectional shape to decrease a stress concentration at the connecting portions between the outermost dividing wall 8 and the peripheral wall 7, even if a stone hits the tube, damage at the connecting portions and a breakage of the tube 1 can be effectively prevented.

In addition, because each outermost unit passage 11*a* is formed to have a circular cross-sectional shape and each intermediate unit passage 11 has a rectangular-based cross-sectional shape, each portion of the tube 1 can be thin, which can lighten the weight of the tube 1, resulting in a light weight heat exchanger. Further, the heat transferring area can be kept larger, as compared to an intermediate unit passage having a circular cross-sectional shape. In addition, because each intermediate unit passage 11 has a plurality of inner fins 15, the heat transferring area can be increased, resulting in a high heat exchanging performance.

Because an inclined inner surface 16 is formed at each corner of the intermediate unit passage 11, the thickness of the dividing wall 8 can be thin, which can lighten the weight of the tube 1 and enhance the pressure resistance of the tube 1.

The inclined inner surface 16 can enlarge the distance between the stress concentration portions A, A at the dividing walls 8 except for the outermost dividing wall 8. This decreases a stress concentration at the connecting portions between the dividing walls 8 and the peripheral wall 7. As for the outermost dividing walls 8, a stress concentration at connecting portions between the outermost dividing wall 8 and the peripheral wall 7 can also be decreased because the outermost unit passage 11*a* has a circular cross-sectional shape with no stress concentration portion and the distance between the stress concentration portion A of the outer most dividing wall 8 and the central portion C of the outermost dividing wall 8 is large. Therefore, the tube 1 has a good pressure resistance. Because high pressure resistance is obtained by forming the inclined inner surfaces 16, the thickness of the dividing wall 8 can be thinner. As a result, a light weight tube can be obtained.

In other words, the weight of the tube 1 can be lighter where the pressure resistance remains the same, or the pressure resistance can be improved where the weight remains the same.

Figure 14A:
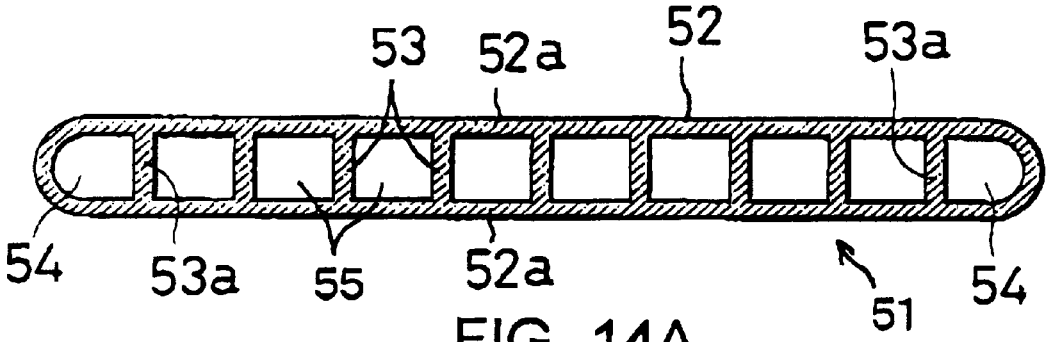
Figure 14B:
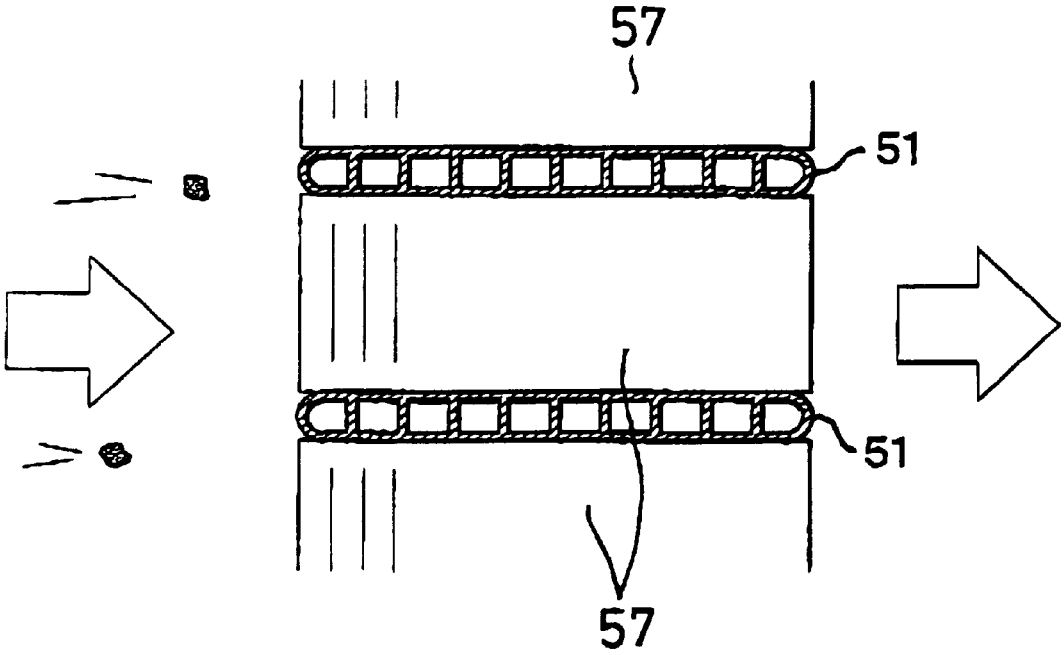
Figure 14C:
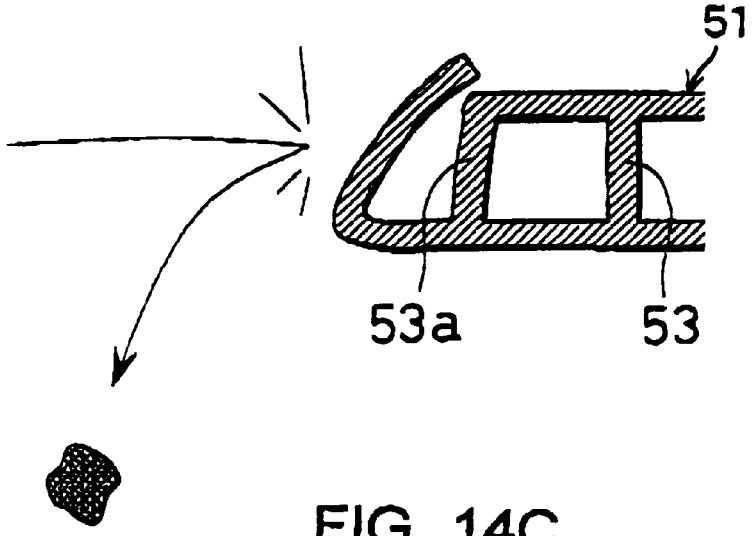
Figure 15A:
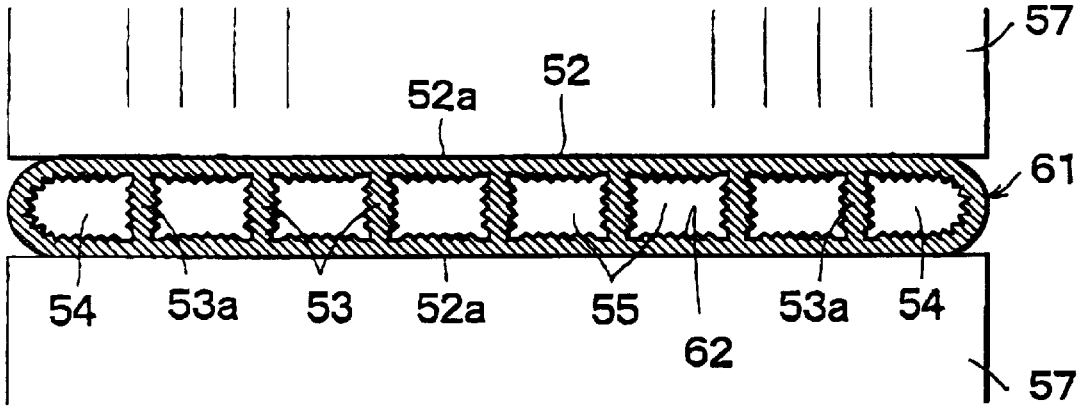
Figure 15B:
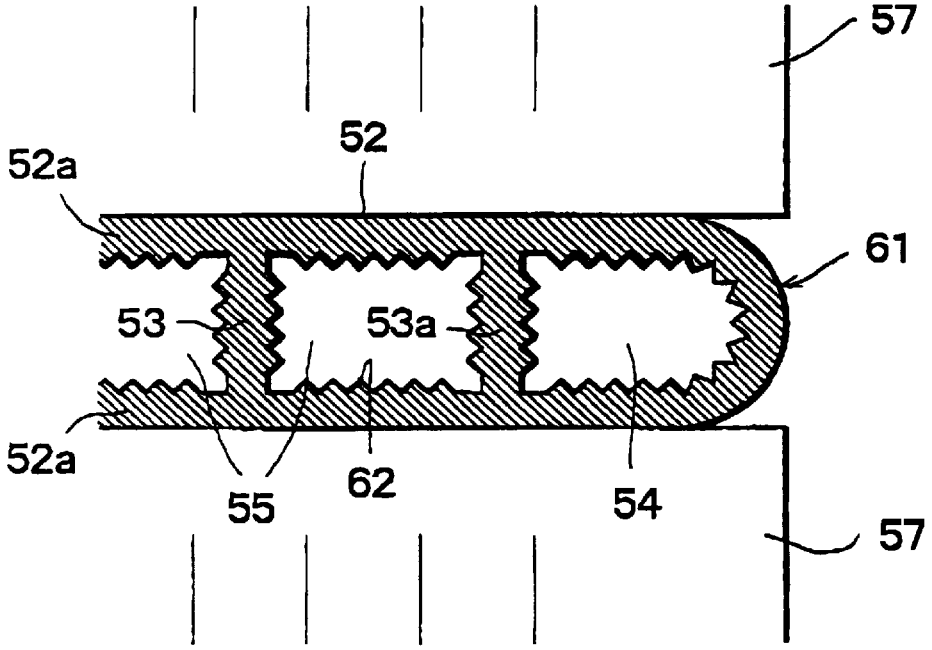

Destructive tests were conducted on the tube shown in FIG. 10 and the conventional tubes shown in FIGS. 14 and 15. The results were as follows. Assuming that the pressure at which the conventional tubes were broken was 100, the pressure of the embodiment shown in FIG. 10 was 120. It was confirmed that the pressure resistance of the tube shown in FIG. 10 was an improvement compared to the conventional tubes.

In this embodiment, each outermost unit passage 11*a* has a perfect circular shape, however, it may have a circumferentially smooth curved shape in cross-section such as an elliptical shape or an elongated circular shape. Continuously formed inner fins 15 each having a triangular cross-sectional shape are shown in the embodiment. However, the inner fin may have various kinds of cross-sectional shapes. Further, the inner fin 15 may be formed on one of the dividing walls 8 or the peripheral walls 7, or may also be discontinuously formed.

Sixth Embodiment

Figure 12B:
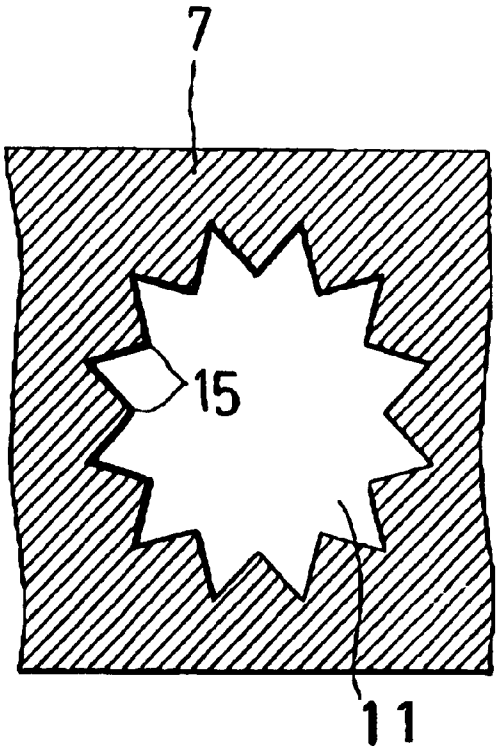
Figure 12A:
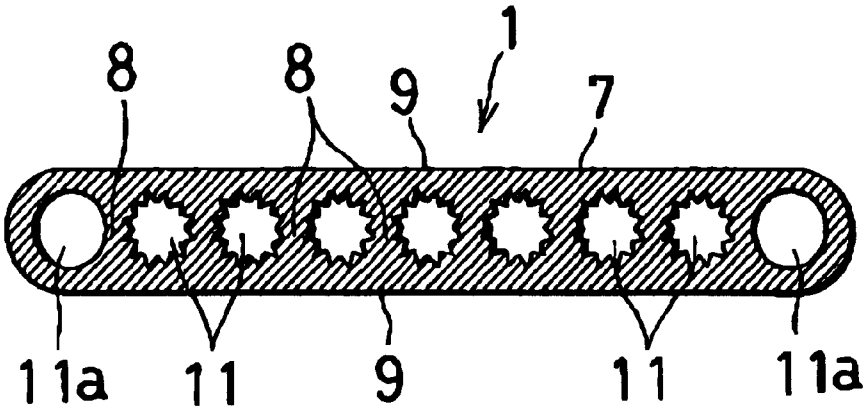

FIGS. 12A–12B shows a sixth embodiment of a multi-bored flat tube 1 according to the present invention.

The inner surface of each outermost unit passage 11*a* is formed to be a circumferentially smooth curved shape in cross-section as in the same manner shown in the other embodiments. Each intermediate unit passages 11 has a star-like shape, in detail, a circular-based inner surface in cross-section having a plurality of triangular cross-sectional inner fins 15 continuously formed along the inner surface and extending in the longitudinal direction of the tube 1.

Because the flat tube 1 has a plurality of inner fins 15 formed on the circular-based inner surface of the intermediate unit passage 11, the pressure resistance is good. In addition, the contact area with the heat exchanging medium can be kept large, whereby a high heat exchanging performance can be obtained.

The flat tube 1 has a plurality of dividing walls 8 connecting the flat wall portions 9, 9, which divide the inner space of the tube 1 into a plurality of unit passages 11, 11*a*, thereby being superior in pressure resistance. Further, each outermost unit passage 11*a* is formed to have a circumferentially smooth curved shape in cross-section. Therefore, a stress concentration on connecting portions between the outermost dividing wall 8 and the flat wall portion 9 can be decreased, which prevents the peripheral wall 7 at the connecting portions from being destroyed.

Because each outermost unit passage 11*a* is formed to have a circumferentially smooth curved shape in cross-section, a breakage of the connecting portions between the outermost dividing wall 8 and the flat wall portion 7 can be prevented due to the stress concentration diminishing effects, which in turn enhances inner pressure resistance performance of the tube 1. Especially, when the outermost unit passage 11*a* is formed to have a perfect circular shape, the inner pressure of the heat exchanging medium passing through the unit passage 11*a* can be equalized on the inner surface of the outermost unit passage 11*a*, resulting in extremely high pressure performance.

Because each outermost unit passage 11*a* has a circumferentially smooth curved shape in cross-section to decrease stress concentration at the connecting portion between the outermost dividing wall 8 and the peripheral wall 7, even if a stone hits the tube, damage at the connecting portions and breakage of the tube 1 can be effectively prevented.

In the embodiment, each outermost unit passage 11*a* has a perfect circular shape, however, it may have a circumferentially smooth curved shape in cross-section, such as an elliptical shape or an elongated circular shape. Continuously formed inner fins 15 each having a triangular cross-sectional shape are shown in the embodiment. However, the inner fin may have various kinds of cross-sectional shapes. Further, the inner fin 15 may also be discontinuously formed.

Seventh Embodiment

Figure 13B:
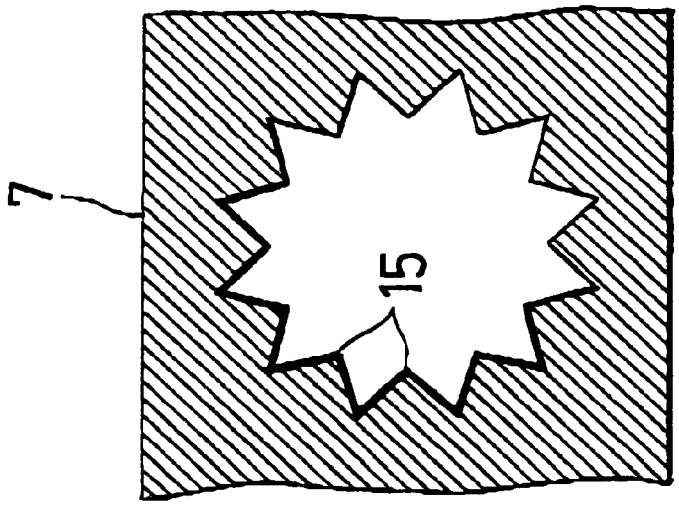
Figure 13A:
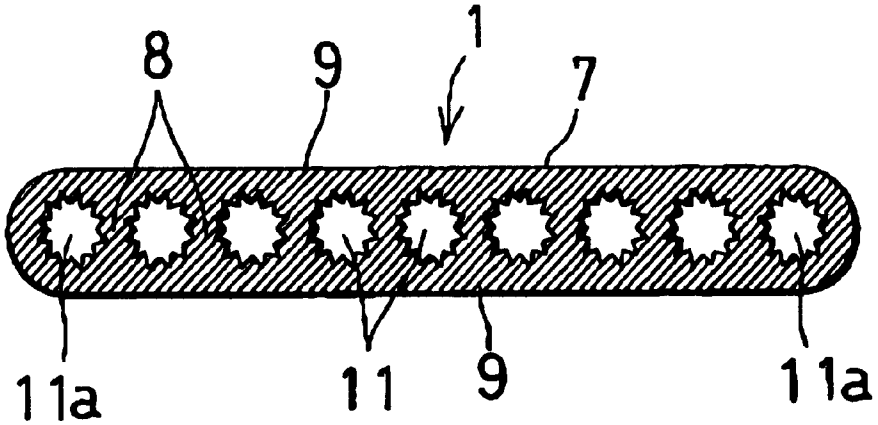

FIGS. 13A–13B show a seventh embodiment of a multi-bored flat tube according to the present invention. This embodiment differs from the sixth embodiment only in that the outermost unit passages 11*a*, 11*a* are also formed to have a star-like cross-sectional shape, respectively.

The flat tube 1 has a plurality of circular-based unit passages 11 including the outermost unit passages 11*a*, thereby being superior in pressure resistance. In addition, because a plurality of inner fins 15 are formed on the inner surface of all of the unit passages 11, 11*a*, the contact area with the heat exchanging medium can be increased, whereby a high heat exchanging performance can be obtained.

The flat tube 1 has a plurality of dividing walls 8 connecting the flat wall portions 9, 9, which divide the inner space of the tube 1 into a plurality of unit passages 11, 11*a*, thereby being superior in pressure resistance. Further, each outermost unit passage 11*a* is formed to have a circular-based cross-sectional shape. Therefore, a stress concentration on connecting portions between the outermost dividing wall 8 and the flat wall portion 9 is decreased, which prevents the peripheral wall 7 at the connecting portions from being destroyed.

Because each outermost unit passage 11*a* is formed to have a circular-based shape in cross-section, a breakage of the connecting portions connecting the outermost dividing wall 8 and the flat wall portion 7 can be prevented due to stress concentration diminishing effects, which in turn enhances inner pressure resistance performance of the tube 1 mounted in a heat exchanger.

Especially, when the tube 1 is used in a condenser for an automobile air conditioner, even if a stone hits the tube, damage at the connecting portions between the outermost dividing wall 8 and the peripheral wall 7 and breakage of the tube 1 can be effectively prevented.

In the embodiment, each unit passage 11, 11*a* has a circular-based shape having a plurality of inner fins, however, it may have an elliptical-based shape or an elongated circular-based shape. Continuously formed inner fins 15 each having a triangular cross-section are shown in the embodiment. However, the inner fin may have various kinds of cross-sectional shapes. Further, the inner fin 15 may also be discontinuously formed.

The flat tube according to the present invention is not limited to a tube for use in a condenser for an automobile air conditioner, and can be used as a tube for use in various kinds of heat exchangers such as, for example, an outdoor heat exchanger for a room air conditioner.

The terminology "circular" used herein is not limited to exact or perfect circles, but encompasses generally circle-like shapes, e.g., rounded shapes, but the most preferred embodiments having such shapes include perfect circles or substantially perfect circles. Similarly, the terminology rectangular, triangular, trapezoidal, elliptical, etc., is not limited to exact or perfect rectangles, triangles, trapezoids, ellipses, etc., but the most preferred embodiments having such shapes include exact or perfect shapes or substantially exact or perfect shapes.

In the above-mentioned embodiments, the tubes are used in a multi-flow type heat exchanger. However, the tubes may also be used in a serpentine type heat exchanger in which a tube is bent in a zigzag manner.

In the above-mentioned embodiments, the outer fin disposed between adjacent tubes 1 is an corrugate fin, but is not limited to this.

In the tube according to the present invention, since the outermost unit passage has a circular-based inner surface in cross-section, a stress concentration on connecting portions between the outermost dividing wall and the peripheral wall can be decreased. Accordingly, a high pressure resistance can be obtained throughout the tube. In a heat-exchanger using the multi-bored flat tube, a high pressure resistance can be obtained by the structure even at both lateral ends of the tube where reinforcing effect by the outer fins is not enough.

Further, a stress concentration on connecting portions between the outermost dividing wall and the peripheral wall can be reduced even when a small article such as a stone hits the tube. Consequently, the peripheral wall at the connecting portions can be prevented from being damaged, resulting in a superior breaking strength against an outside stress caused when a small article such as a stone hits the tube.

Each of the intermediate unit passages is designed to have a non-circular inner surface in cross-section. This can prevent the thickness of upper and lower portions of the dividing wall from being thickened, as compared to an intermediate unit passage having a circular-based inner surface, which results in a decreased amount of material forming the tube, thereby decreasing the weight and cost of the tube. In addition, within a limited thickness of the tube, a larger contact area with the heat exchanging medium can be obtained as compared to an intermediate unit passage having a circular inner surface, which in turn can obtain a high heat exchanging performance.

The above effects can also be obtained by the outermost unit passage having a circumferentially smooth curved shape in cross-section.

In a tube that has an outermost unit passage of a star-like shape in cross-section having a plurality of inner fins extending in a longitudinal direction of the tube, the same functions and effects can be obtained. Because a plurality of inner fins are formed on the inner surface of the outermost unit passage, a contact area with a heat exchanging medium in the outermost unit passage can be enlarged, thereby improving a heat exchange performance.

In a tube having an intermediate unit passage which is adjacent to the outermost unit passages and has a semi-circular inner surface at the outermost unit passage side, a stress concentration on the connecting portions between the outermost dividing wall and the peripheral wall can be decreased to improve the strength, whereby the peripheral wall at the connecting portions can effectively be prevented from being broken.

If a sidewall portion has a rounded shape and is formed relatively thicker than the flat wall portions, the sidewall portion can be prevented from being broken or deformed when small article such as a stone hits the tube. In addition, since the thickness of the flat wall portions is kept relatively thin, an optimal heat transmission performance can be maintained and a weight increase can be decreased, resulting in a light-weight heat exchanger. Further, the structure does not cause an increase in the pressure loss of the heat exchanging medium.

Similar effects can be obtained by the intermediate unit passage having a square, triangular, or trapezoidal shape in cross-section.

A high performance of pressure-resistance and a large heat transmission area can be obtained by the intermediate unit passage having a circular-based cross-sectional shape with a plurality of inner fins extending in a longitudinal direction of the tube. The intermediate unit passage may have a star-like shape in cross-section.

Superior destructive strength against outer stress can be obtained by a multi-bored flat tube for use in a heat-exchanger comprising:

a peripheral wall including flat wall portions facing with each other at a certain distance and sidewall portions connecting ends of the flat wall portions; and dividing walls connecting the flat wall portions and dividing an inside space defined by the peripheral wall to form a plurality of unit passages arranged in a lateral direction of the tube, wherein the plurality of unit passages include outermost unit passages located at both lateral ends of the tube and intermediate unit passages located between the outermost unit passages, and wherein each of the outermost unit passages has a circular-based inner surface in cross-section, and each of the intermediate unit passages has a modified cross-sectional shape.

In addition, within a limited thickness of the tube, a larger contact area with the heat exchanging medium can be obtained as compared to an intermediate unit passage having a circular inner surface in cross-section, which in turn can obtain a high heat exchanging performance.

In a tube that includes outermost unit passages each having a circumferentially smooth curved shape in cross-section and intermediate unit passages each having a rectangular-based cross-section with a plurality of inner fins extending in the longitudinal direction of the tube, a stress concentration on connecting portions between the outermost dividing wall and the peripheral wall can be reduced when a small article such as a stone hits the tube. Consequently, the peripheral wall at the connecting portions can be prevented from being damaged, resulting in superior breaking strength against an outside stress caused when a small article such as a stone hits the tube. Further, when each intermediate unit passage has a rectangular-based shape having a plurality of inner fins extending in the longitudinal direction of the tube, the thickness of upper and lower portions of the dividing wall can be prevented from being thickened as compared to an intermediate unit passage having a circular-based inner surface, which results in a decreased amount of material, thereby decreasing the weight and cost of the tube. In addition, within a limited thickness of the tube, a larger contact area with the heat exchanging medium can be obtained as compared to an intermediate unit passage having a circular inner surface, which in turn can obtain a high heat exchanging performance.

A heat exchanger including the above-mentioned multi-bored flat tubes has an improved strength against a stone which hits the tube, an excellent heat exchanging performance, and a low pressure loss.

Although the invention has been described in connection with specific embodiments, the invention is not limited to such embodiments, and as would be apparent to those skilled in the art, various substitutions and modifications within the scope and spirit of the invention are contemplated.

What is claimed is:

1. A multi-bored flat tube for use in a heat exchanger, comprising:

a peripheral wall including flat wall portions facing each other at a certain distance and sidewall portions connecting lateral ends of said flat wall portions; and dividing walls each connecting said flat wall portions and dividing an inside space defined by said peripheral wall into a plurality of unit passages arranged in a lateral direction of said tube, wherein said plurality of unit passages include outermost unit passages located at both lateral ends of said tube and intermediate unit passages located between said both outermost unit passages, wherein each of said outermost unit passages has a circular-based inner surface in cross-section, and wherein each of said intermediate unit passages has a non-circular-based inner surface in cross-section, wherein each of said outermost unit passages has a circumferentially smooth curved inner surface in cross-section.

2. The multi-bored flat tube for use in a heat-exchanger as recited in claim 1, wherein each of said outermost unit passages has a circular-based inner surface in cross-section and a plurality of inner fins formed on said inner surface and extending in a longitudinal direction of said tube.

3. The multi-bored flat tube for use in a heat-exchanger as recited in claim 1, wherein each of said sidewall portions is formed to have a round shape in cross-section and is relatively thicker than said flat wall portions.

4. The multi-bored flat tube for use in a heat-exchanger as recited in claim 1, wherein each of said intermediate unit passages has a square cross-sectional shape.

5. The multi-bored flat tube for use in a heat-exchanger as recited in claim 1, wherein each of said intermediate unit passages has a triangular cross-sectional shape.

6. The multi-bored flat tube for use in a heat-exchanger as recited in claim 1, wherein each of said intermediate unit passages has a trapezoidal cross-sectional shape.

7. The multi-bored flat tube for use in a heat-exchanger as recited in claim 1, wherein each of said intermediate unit passages has a plurality of inner fins extending in a longitudinal direction of said tube.

8. A heat exchanger comprising:

a plurality of multi-bored flat tubes disposed in a direction of a thickness of said tube at certain intervals;

a plurality of fins interposed between said adjacent tubes; and a pair of headers each located at an end of said tube and connected with said tube in fluid communication, whereby a heat exchanging medium flows through more than two of said tubes at the same time, wherein said multi-bored flat tube includes:

a peripheral wall including flat wall portions facing with each other at certain distance and sidewall portions connecting lateral ends of said flat wall portions; and dividing walls each connecting said flat wall portions and dividing an inside space defined by said peripheral wall into a plurality of unit passages arranged in a lateral direction of said tube, wherein said plurality of unit passages include outermost unit passages located at both lateral ends of said tube and intermediate unit passages located between said both outermost unit passages, wherein each of said outermost unit passages has a circular-based inner surface in cross-section, and wherein each of said intermediate unit passages has a non-circular inner surface in cross-section, wherein each of said outermost unit passages has a circumferentially smooth curved inner surface in cross-section.

9. A multi-bored flat tube for use in a heat exchanger, comprising:

a peripheral wall including flat wall portions facing each other at a certain distance and sidewall portions connecting lateral ends of said flat wall portions; and dividing walls each connecting said flat wall portions and dividing an inside space defined by said peripheral wall into a plurality of unit passages arranged in a lateral direction of said tube, wherein said plurality of unit passages include outermost unit passages located at both lateral ends of said tube and intermediate unit passages located between said both outermost unit passages, wherein each of said outermost unit passages has a circular-based inner surface in cross-section, and wherein each of said intermediate unit passages has a non-circular-based inner surface in cross-section, wherein each of said intermediate unit passages adjacent to said outermost unit passages has a semi-circular inner surface at an outermost unit passage side.

* * * * *